US010024018B2

(12) United States Patent
Bradac

(10) Patent No.: US 10,024,018 B2
(45) Date of Patent: Jul. 17, 2018

(54) METHOD OF FORMING A CONCRETE COLUMN UTILIZING A THERMOPLASTIC CONCRETE FORMING TUBE

(71) Applicant: James M. Bradac, Hudson, WI (US)

(72) Inventor: James M. Bradac, Hudson, WI (US)

( * ) Notice: Subject to any disclaimer, the term of this patent is extended or adjusted under 35 U.S.C. 154(b) by 31 days.

(21) Appl. No.: 15/672,864

(22) Filed: Aug. 9, 2017

(65) Prior Publication Data

US 2017/0335536 A1 Nov. 23, 2017

Related U.S. Application Data

(63) Continuation-in-part of application No. 12/280,714, filed as application No. PCT/US2007/062951 on Feb. 28, 2007, now Pat. No. 9,758,942.

(60) Provisional application No. 60/782,103, filed on Mar. 14, 2006.

(51) Int. Cl.

| | |
|---|---|
| ***E02D 5/38*** | (2006.01) |
| ***E02D 27/42*** | (2006.01) |
| ***E02D 5/66*** | (2006.01) |
| ***E02D 15/04*** | (2006.01) |

(52) U.S. Cl.

CPC ..... *E02D 5/38* (2013.01); *E02D 5/665* (2013.01); *E02D 15/04* (2013.01); *E02D 27/42* (2013.01)

(58) Field of Classification Search

CPC .. E02D 5/36; E02D 5/38; E02D 5/665; E02D 27/42; E02D 15/05; E02D 5/34; E02D 5/50; E02D 15/04; E04H 12/2292

USPC ..... 52/741.14, 741.15, 741.17; 249/48, 49, 249/51; 264/32; 285/31, 32; 138/109; 428/36.92, 36.9, 35.7, 34.1

See application file for complete search history.

(56) References Cited

U.S. PATENT DOCUMENTS

| | | | | |
|---|---|---|---|---|
| 4,078,867 | A * | 3/1978 | Ronden | E01F 9/629 404/10 |
| 4,255,071 | A * | 3/1981 | Koppers | E21D 15/02 248/354.1 |
| 5,890,333 | A * | 4/1999 | Boroviak | E02D 27/42 249/48 |
| 6,318,700 | B1 * | 11/2001 | Cliff | E02D 27/01 249/13 |
| 2004/0111991 | A1 * | 6/2004 | Swinimer | E02D 5/44 52/294 |

* cited by examiner

*Primary Examiner* — Michael Safavi
(74) *Attorney, Agent, or Firm* — Sherrill Law Offices, PLLC

(57) ABSTRACT

A concrete forming tube formed from a thermoplastic material and having a first end, a second end, and a substantially uniform circumference from the first end to the second end.

6 Claims, 4 Drawing Sheets

METHOD OF FORMING A CONCRETE COLUMN UTILIZING A THERMOPLASTIC CONCRETE FORMING TUBE

FIELD OF INVENTION

This invention relates to concrete forms for posts and structural pillars.

BACKGROUND OF THE INVENTION

The use of structural pillars and posts that serve as a foundation or prop for a structure or item such as outdoor sign posts, light poles, lamps posts, fence posts, pilings for decks and homes, play structures, gardens, and mailboxes is well known in the construction industry and home maintenance industry. The pillars and posts are constructed using a settable material such as concrete which is poured into a form. Typically a tubular form is used. Tubular forms made of spirally wrapped paper are well known in the above-mentioned industries. The paper forms are normally set, at least partially, below grade in a hole. The tube is then filled with liquid concrete. Once the concrete has set, the form is removed if the confines of the hole allow or the form is left on the concrete to deteriorate over time.

The paper forms are subject to damage if exposed to relatively wet conditions, such as being submersed into a hole with water seepage. Being subject to water damage, the time frame for completing the form pouring is limited to reduce the possibility of changing weather conditions or seepage of water over time.

Therefore, what is needed is a form that is usable in less than ideal building conditions.

Weather conditions and water seepage not only affect the paper form, they may affect the concrete pillar or post once poured. In areas of the United States, the weather conditions are such as to cause freezing of the ground in colder months. The earth above the frost line is subject to frost heaving in these areas. Frost heaving can cause damage to structures and items that are supported by pillars or posts. The frost heave shifts the position of the earth above the frost line, thereby moving the position of the pillar or post resting on or in the affected earth and potentially damaging the structure or item support by the pillar or post.

Therefore, what is needed is a means of limiting the damage to a structure or item supported by pillars or posts from frost heave.

SUMMARY OF THE INVENTION

A first embodiment of the invention is a concrete forming tube having an integrally formed slide fit connector at one end of the forming tube.

A second embodiment of the invention is a concrete forming tube formed from a thermoplastic material and having a first end, a second end, and a substantially uniform circumference from the first end to the second end.

A third embodiment of the invention involves obtaining at least two concrete forming tubes formed from a thermoplastic material and having a first end, a second end, and a substantially uniform circumference from the first end to the second end of each tube. At least one forming tube has an integrally formed slide fit connector at the second end of the forming tube. The forming tubes are connected together with the slide fit connector. Concrete is poured into the forming tubes.

DETAILED DESCRIPTION OF THE INVENTION INCLUDING A BEST MODE

Nomenclature

Figure 1:
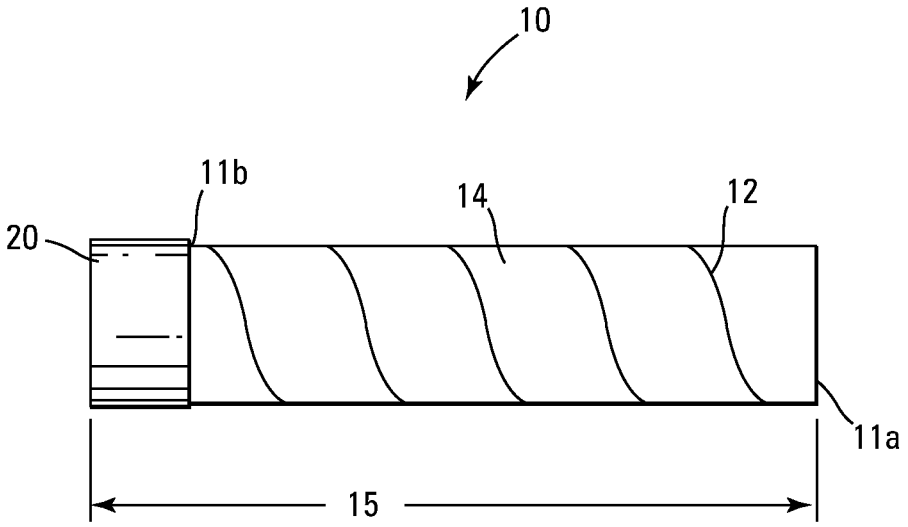
FIG. 1 is side view of one embodiment of the invention.

10 Forming tube
11*a* First end
11*b* Second end
12 Scoring lines
13 Interior surface
14 Exterior Surface
15 Longitudinal Length
16*a* Outer circumference
16*b* Inner circumference
17 End cap
17*a* Opening
20 Connector
100 Earth
200 Light pole Construction The concrete forming tube 10 may be used to form pillars, posts, supports, piers, columns, shafts, pilings, or pier footings that serve as a foundation or prop for a structure or item such as outdoor sign posts, light poles, lamps posts, fence posts, pilings for decks and homes, play structures, gardens, and mailboxes. Deck pilings are one of the most common uses of supports in the residential industry. Therefore, the remainder of the discussion will be based upon a concrete forming tube 10 used to form deck pilings.

As shown in FIG. 1, one embodiment of the invention is a concrete forming tube 10. The forming tube 10 may be made from any suitable material having the desired characteristics, including, for example, metal, paper, plastic, or rubber materials. The preferred material is thermoplastic material; the most preferred material is a recyclable thermoplastic material such as polyethylene. The use of thermoplastic material such as polyethylene may allow the forming tube 10 to be used in wet areas as water may not penetrate the forming tube 10 during pouring and affect the quality of the liquid concrete poured into the forming tube 10. The use of a material such as polyethylene may also allow the forming tube 10 to be set into place a period of time prior to pouring without underground water or weather conditions significantly affecting the quality of the forming tube 10. The use of a material such as polyethylene may also allow the forming tube 10 to reduce the effects of frost heaving as materials such as polyethylene may decompose at a much slower rate than other materials such as paper. Preferably the material used is rigid and sufficiently strong to withstand the pressure from the earth 100 on the outside of the tube 10 prior to filing the tube 10 with concrete. The material used may also have reflective properties, UV inhibitors, or color added.

Figure 2:
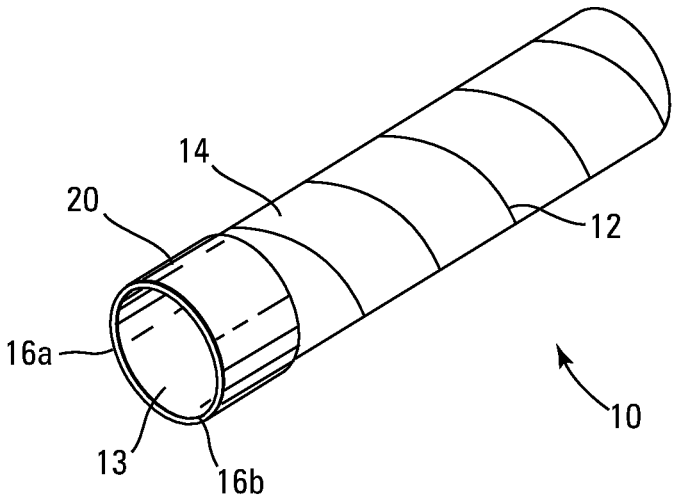
FIG. 2 is a perspective view of the invention in FIG. 1.

As shown in FIGS. 1 and 2, the concrete forming tube 10 has at least a longitudinal length 15, an outer circumference 16*a*, an inner circumference 16*b*, a first end 11*a*, a second end 11*b*, an interior surface 13, and an exterior surface 14.

The longitudinal length 15 may be any suitable length for the desired piling needed. Preferably the longitudinal length 15 is between about one and six feet. The most preferred longitudinal length 15 is about four feet. The outer circumference 16*a* and inner circumference 16*b* of the forming tube 10 may be any desired shape and size. The shape may be a polygon, a circle, and an ellipse. The preferred shape is a circle. The size of the shape may be any suitable size for the desired piling needed. The preferred size is between about three and 60 inches. The most preferred size is between about six and 20 inches. Preferably both the inner circumference 16*b* and the outer circumference 16*a* of the forming tube 10 are the same shape. Preferably the outer circumference 16*a* and the inner circumference 16*b* are substantially uniform along the longitudinal length 15 of the tube 10 from the first end 11*a* to the second end 11*b* wherein any variation in the outer circumference 16*a* or inner circumference 16*b* along the longitudinal length 15 of the tube 10 is due to standard deviations in the manufacturing equipment.

The forming tube 10 may be manufactured using any suitable method for the material chosen. Preferably the forming tube 10 is manufactured so as to provide a smooth interior surface 13 allowing the cured concrete to slide along the longitudinal length 15 of the forming tube 10. A smooth interior surface 13 may also provide a smooth exterior surface of the finished pier when the tube 10 is removed. The exterior surface 14 of the forming tube 10 may be smooth or textured. Preferably the exterior surface 14 is substantially smooth to allow the earth 100 surrounding a tube 10 to not adhere to the tube 10 to help prevent frost heaving. As shown in FIGS. 1 and 2, the exterior surface 14 may also have a series of scoring lines 12 spaced along the longitudinal length 15 of the forming tube 10. The scoring lines 12 may aid in removal of the forming tube 10 after the piling is poured. Preferably the forming tube 10 is manufactured as a one-piece unitary tube 10.

The forming tube 10 thickness (not numbered), between the interior surface 13 and the exterior surface 14, may be any suitable thickness sufficient to hold the full hydrostatic pressure of the concrete poured into the forming tube 10. The preferred forming tube 10 thickness is between about one-eighth inch and three inches. The most preferred forming tube 10 thickness is about one-eighth inch.

Figure 3:
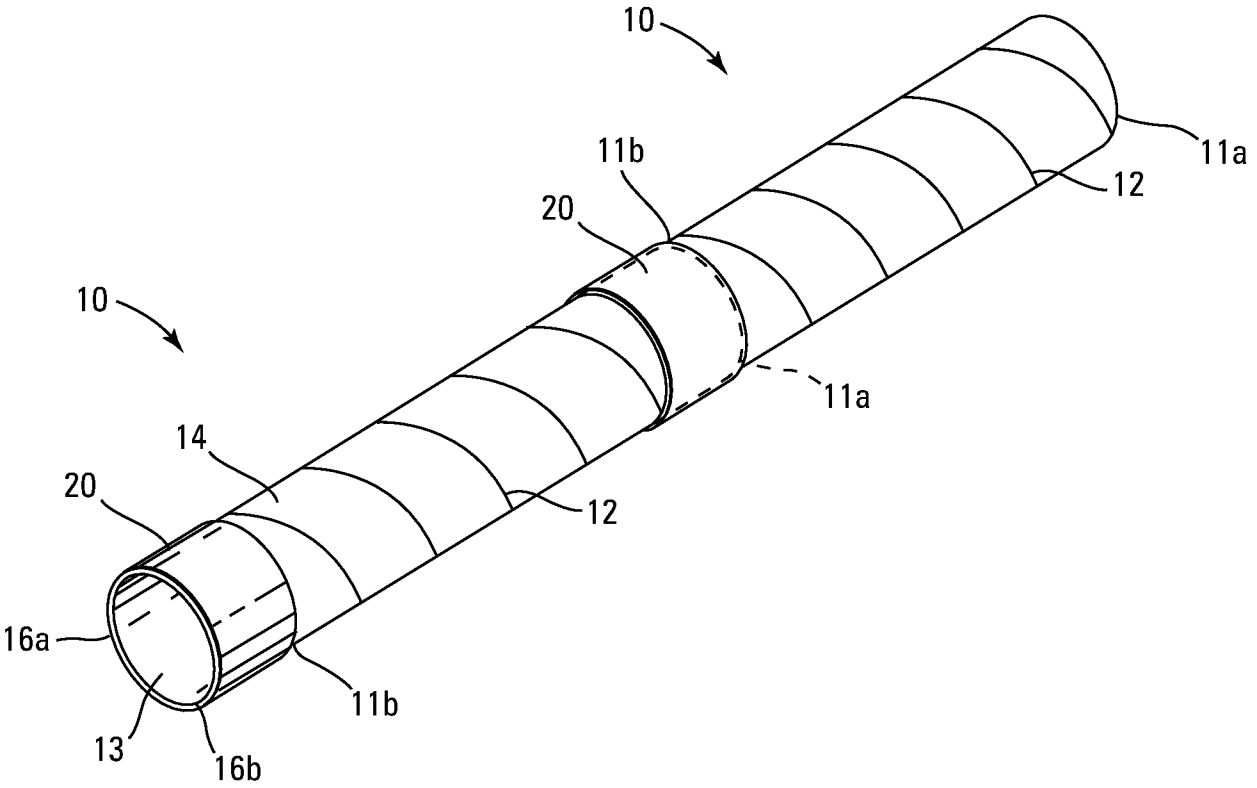
FIG. 3 is a perspective view of two of the inventions in FIG. 1 connected together to form a longer forming tube.
Figure 4:
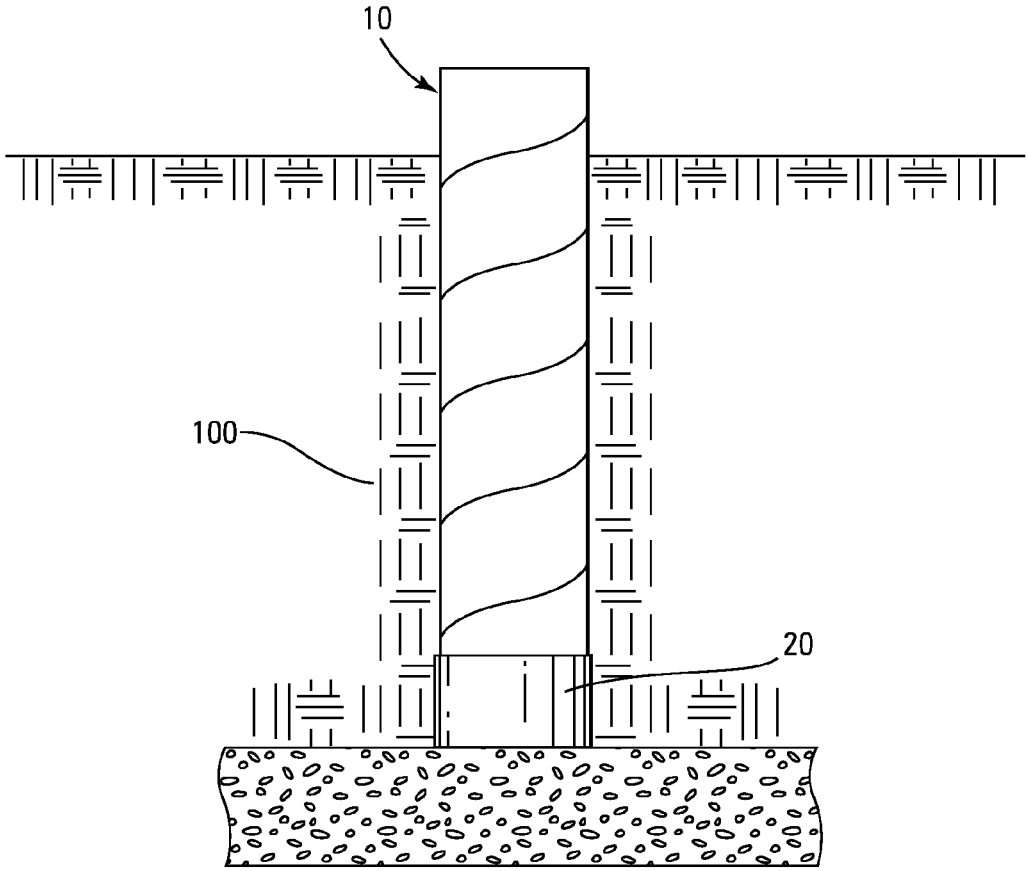
FIG. 4 is a side elevation view, partially in section of the invention in FIG. 1, showing the invention in use.

As shown in FIG. 3, the concrete forming tubes 10 may be connected together to provide a form with a longer longitudinal length (not numbered).

The forming tubes 10 may be connected using any suitable known means of connecting pieces of thermoplastic material. The preferred method of connection is a slide fit connector 20. The most preferred method of connection is an integrally formed slide fit connector 20 at the second end 11*b* of the forming tube 10.

The forming tube 10 may also have an end cap 17. The end cap 17 may be configured and arranged to fit over the first end 11*a* of the tube 10. Preferably the end cap 17 is integrally formed with the tube 10 over the first end 11*a* of the tube 10. The cap 17 may be used to prevent water and debris from entering the tube 10 prior to filling the tube 10 with concrete. The end cap 17 may also have an opening 17*a* through the end cap 17 to allow a light pole 200 to be mounted on the finished pier (not numbered). The end cap 17 may be any shape that allows the end cap 17 to fit over the first end 11*a* of the tube 10. Preferably the end cap 17 is a spherical sector.

Use

One method of use of the forming tube 10 may be to form pilings or pier footings for decks in a desired location. The forming tube 10 may be placed in the location desired for a piling (not shown). The piling may be above grade or below grade. Most pilings are at least partially below grade to provide added support for the piling.

A hole (not numbered) may be excavated for at least a portion of the forming tube 10 to be inserted below grade. The hole may be just large enough to allow the forming tube 10 to be inserted. The hole may be larger to allow the insertion of a footing for the piling or even larger. If the longitudinal length of the piling is less than the longitudinal length 15 of the forming tube 10, the forming tube 10 may be cut to the desired length. If the longitudinal length of the piling is more than the longitudinal length 15 of a single forming tube 10, multiple forming tubes 10 may be connected to provide the desired longitudinal length of piling. As shown in FIG. 2, the forming tube 10 may have an integrally formed slide fit connector 20 on at least the second end 11*b*. As shown in FIG. 3, the slide fit connector 20 on one forming tube 10 may be connected to another forming tube 10 by sliding the slide fit connector 20 of one forming tube 10 over the first end 11*a* of another forming tube 10 without a slide fit connector 20.

Once the forming tube 10 is placed in the desired location, liquid concrete (not shown) may be poured into the forming tube 10. After the concrete has cured the proper amount of time, the forming tube 10 may be removed from the piling and reused or recycled. A series of scoring lines 12 evenly spaced along the longitudinal length 15 of the forming tube 10 may aid in removal of the forming tube 10 after the piling is poured.

The forming tube 10 may also be left on the piling indefinitely. If the forming tube 10 is placed in the earth 100 so that at least a portion of the longitudinal length 15 is below grade, the forming tube 10 may provide an aid to prevent frost heaving of the piling.

A portion of the longitudinal length 15 of the forming tube 10 may be placed below grade. The liquid concrete is then poured into the forming tube 10. The portion of the longitudinal length 15 of the filled forming tube 10 below grade is surrounded with earth 100 (either as the hole the forming tube 10 was inserted into was just large enough for the forming tube 10 or the hole was back filled with earth 100 after the forming tube 10 was placed in the hole). Over time the filled forming tube 10 and surrounding earth 100 may be subject to the effects of water (not shown) freezing within the earth 100. As the water in the earth 100 around the forming tube 10 freezes it exerts a gripping force on the portion of the longitudinal length 15 of the filled forming tube 10 that is above the frost line. The smooth interior surface 13 of the forming tube 10 may allow the forming tube 10 to move upward without moving the portion of the piling inside the forming tube 10. The frozen earth 100 may also slide up the longitudinal length 15 of the exterior surface 14 of the forming tube 10 without moving the pillar or the forming tube 10. Thus the forming tube 10 may reduce the effects of friction frost heaving on the piling. A portion of the longitudinal length 15 of the forming tube 10 may also be placed below the frost line to further help reduce the effects of frost heaving on the piling.

Another method of use of the forming tube 10 may be to form a permanent bollard. The forming tube 10 may be partially below grade to provide added strength to the bollard. A hole may be excavated for insertion of the forming tube 10. The forming tube 10 may then be inserted into the hole. Concrete may then be poured into the tube 10. After the concrete has cured the tube 10 may be removed to provide a smooth bollard. The tube 10 may also be left in place around the finished bollard. An end cap 17 may be inserted over the first end 11*a* of the forming tube 10 to provide a finished look to the bollard. The forming the tube 10 may be manufactured with thermoplastic material having reflective, colored, or UV inhibitor properties to improve the look or maintainability of the bollard. For example, the bollard may have a forming tube 10 that is colored yellow and incorporates reflective material that provides a clear reflective appearance of the bollard to the headlights of oncoming vehicles.

Figure 5:
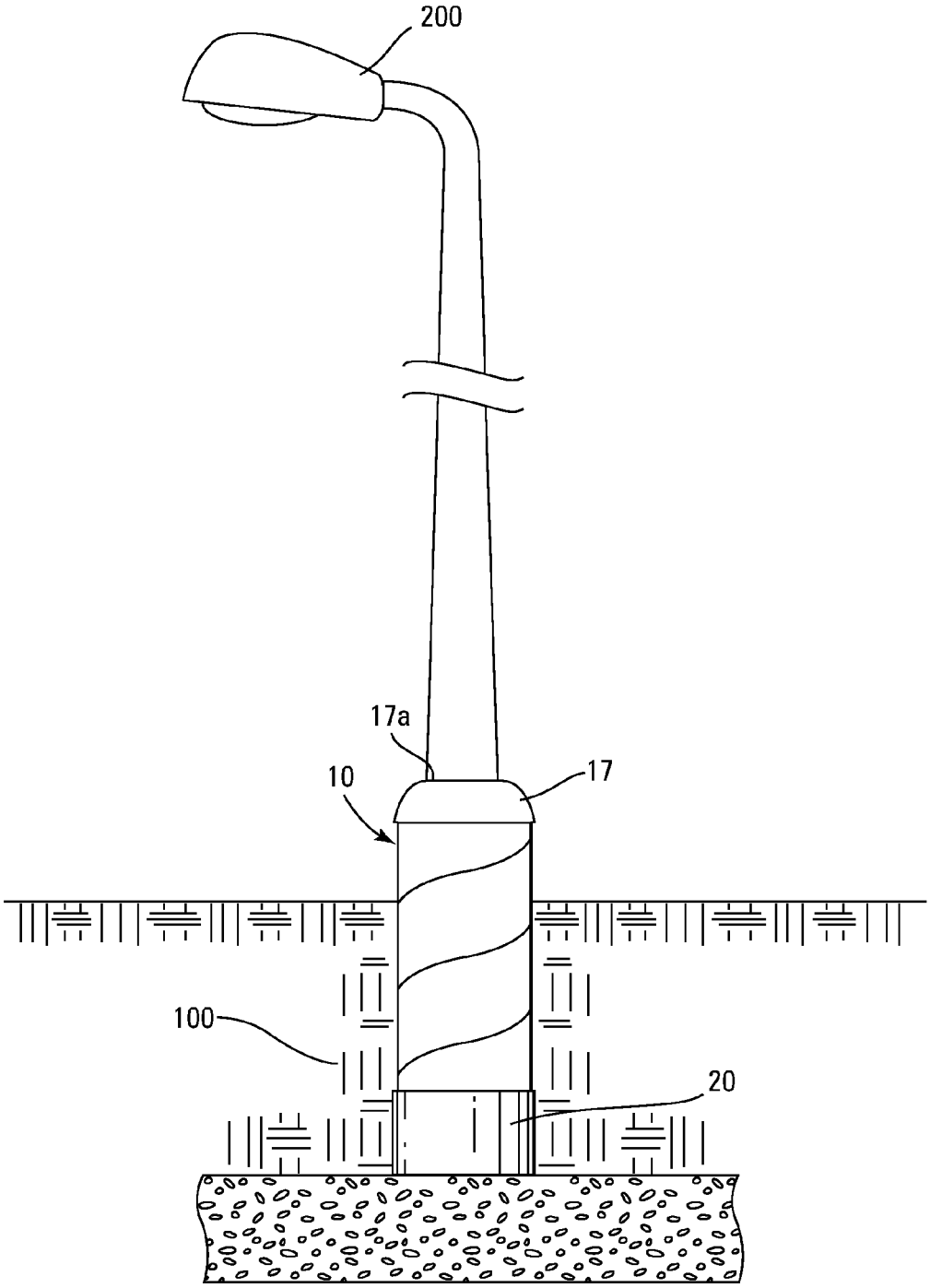
FIG. 5 is a side elevation view, partially in section of the invention in FIG. 1 with an end cap on the tube.

As shown in FIG. 5, a third method of use of the forming tube 10 may be to form a light pole 200 base (not numbered). The forming tube 10 may be partially below grade to provide added strength to the base or entirely above ground. The forming tube 10 is partially inserted into an excavated hole or secured to the ground. The tube 10 may have no end cap 17 or it may have an end cap 17 with an opening 17*a* through the end cap 17. The end cap 17 with the opening 17*a* may be integrally formed with the tube 10 or it may be inserted over the first end 11*a* of the tube 10. Concrete may then be poured into the tube 10 and end cap 17 through the opening 17*a*. After the concrete has cured the tube 10 may be removed to provide a smooth light pole 200 base with a finished top. The tube 10 may also be left in place around the finished light pole 200 base. The forming tube 10 may be manufactured with thermoplastic material having reflective, colored, or UV inhibitor properties to improve the look or maintainability of the light pole 200 base.

I claim:

1. A method of forming a concrete column comprising the steps of (a) excavating soil to form a hole, (b) inserting a first longitudinal end of a concrete forming tube into the hole wherein the concrete forming tube comprises a monolithic thermoplastic tube having an axial length of at least four feet and a channel of uniform cross-sectional shape along the entire axial length of the tube, and (c) pouring concrete into the concrete forming tube from a second longitudinal end of the concrete forming tube.

2. The method of claim 1 wherein the first longitudinal end of the concrete forming tube is positioned below the frost line.

3. The method of claim 1 wherein the concrete column is a bollard.

4. The method of claim 1 wherein the concrete column is a footing.

5. The method of claim 2, wherein the tube is yellow and is embedded with light reflective material.

6. A method of forming a concrete column comprising the steps of (a) excavating soil to form a hole, (b) inserting a first longitudinal end of a concrete forming tube into the hole wherein the concrete forming tube consists of a monolithic thermoplastic tube having an axial length of at least four feet and a channel of uniform cross-sectional shape along the entire axial length of the tube, and (c) pouring concrete into the concrete forming tube from a second longitudinal end of the concrete forming tube.

* * * * *